United States Patent [19]

Longsworth

[11] 4,430,863

[45] Feb. 14, 1984

[54] APPARATUS AND METHOD FOR INCREASING THE SPEED OF A DISPLACER-EXPANDER REFRIGERATOR

[75] Inventor: Ralph C. Longsworth, Allentown, Pa.

[73] Assignee: Air Products and Chemicals, Inc., Allentown, Pa.

[21] Appl. No.: 385,612

[22] Filed: Jun. 7, 1982

[51] Int. Cl.[3] ..... F25B 9/00

[52] U.S. Cl. ..... 62/6; 60/520; 137/624.13; 137/625.21

[58] Field of Search ..... 62/6; 60/520; 137/624.13, 625.21

[56] References Cited

U.S. PATENT DOCUMENTS

| | | | |
|---|---|---|---|
| 3,119,237 | 1/1964 | Gifford | 62/6 |
| 3,205,668 | 9/1965 | Gifford | 62/6 |
| 3,312,072 | 4/1967 | Gifford | 62/6 |
| 3,536,451 | 10/1970 | Ludwin | 137/624.13 |
| 3,620,029 | 11/1971 | Longsworth | 62/6 |
| 3,625,015 | 12/1971 | Chellis | 62/6 |
| 3,937,252 | 2/1976 | Ishida | 137/624.13 |

*Primary Examiner*—Ronald C. Capossela
*Attorney, Agent, or Firm*—James C. Simmons; E. Eugene Innis

[57] ABSTRACT

A method and apparatus for increasing the refrigeration capacity of a displacer-expander type cryogenic refrigerator pneumatically actuated by a rotary valve by increasing the number of ports of the rotary valve to increase reciprocating speed of the displacer without increasing speed of rotation of the valve.

3 Claims, 9 Drawing Figures

APPARATUS AND METHOD FOR INCREASING THE SPEED OF A DISPLACER-EXPANDER REFRIGERATOR

TECHNICAL FIELD

The present invention pertains to a method and apparatus for producing cryogenic refrigeration and in particular a pneumatically actuated cryogenic expander.

BACKGROUND OF THE PRIOR ART

A device for producing cryogenic refrigeration of the type for which the present invention is ideally suited is disclosed and claimed in U.S. Pat. No. 3,620,029. Patentee discloses a displacer-expander type refrigerator where the displacer is cycled against a volume of surge fluid driven through an orifice so that external driving means for the displacer are unnecessary. Work is expended by forcing the surge gas through the orifice into a surge volume chamber whereby the heat generated by such action can be removed by suitable heat exchange. The device of U.S. Pat. No. 3,620,029 includes a two ported rotary valve for admitting high pressure fluid to the variable volume chamber or cold end of the refrigerator and exhausting low pressure expanded gas from the refrigerator. The device according to U.S. Pat. No. 3,620,029 may have more than one stage and most current devices of this type employ two stage refrigeration such that at the first stage of the refrigerator temperatures of between 35° and 85° Kelvin (K.) are achieved when helium is the working fluid and temperatures of 10° to 20° Kelvin are achieved at the second stage with the same working fluid.

U.S. Pat. No. 3,119,237 discloses a refrigerator of the type using a rotary valve which tends to promote leakage as the valve wears.

U.S. Pat. No. 3,205,668 shows a current two ported valve of the type employed with a pneumatically actuated refrigerator.

U.S. Pat. Nos. 3,625,015 and 3,312,072 show a single and dual rotary valve disk respectively.

BRIEF SUMMARY OF THE INVENTION

The present invention provides a method and apparatus for increasing the refrigeration capacity of a pneumatically actuated displacer-expander type refrigerator where actuation takes place by a rotary valve operating at a fixed speed. By increasing the number of ports in the rotary valve so that high pressure fluid is admitted to and exhausted from the variable volume chamber underneath the expander piston with more frequency than every 180° of rotation of the valve the refrigeration capacity is increased by a significant amount at both stages of a two stage displacer-type refrigerator. The substantial increase in refrigeration capacity is noted whether the motor is operated on 50 or 60 cycle power.

DETAILED DESCRIPTION OF THE INVENTION

Figure 1:
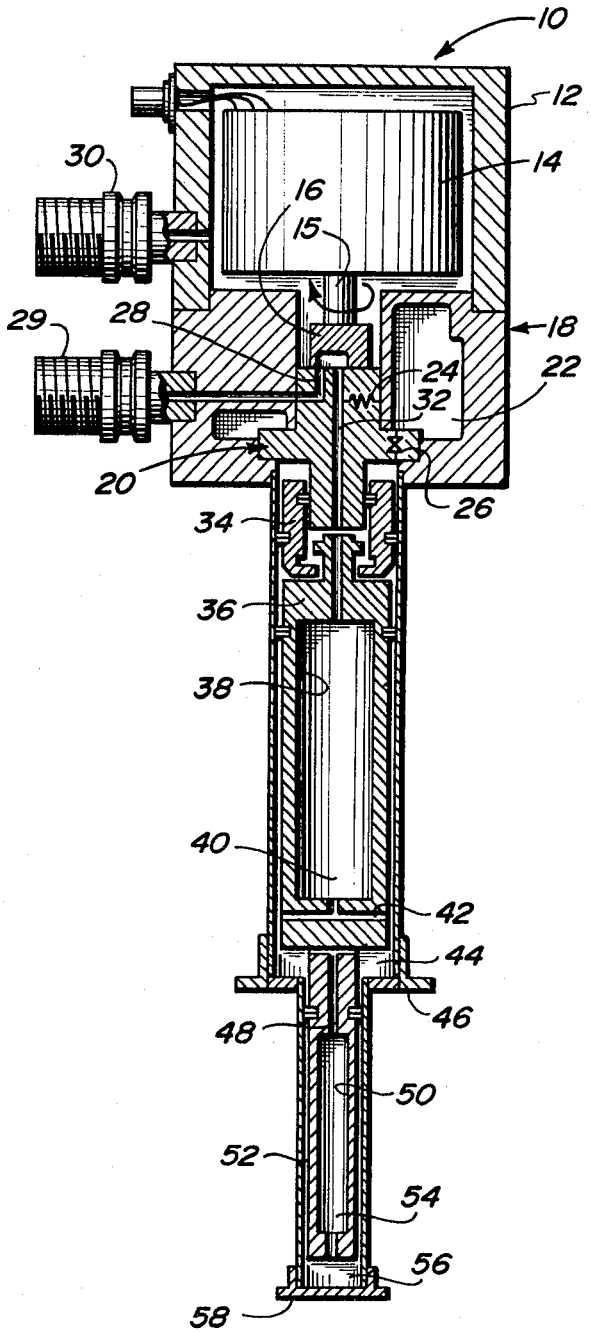
FIG. 1 is a cross-section schematic of a displacer-expander type refrigerator to which the present invention is applicable.

Referring to FIG. 1, there is shown a cryogenic refrigerator 10 such as disclosed and claimed in U.S. Pat. No. 3,620,029, the specification of which is incorporated herein by reference. The refrigerator of FIG. 1 includes a valve motor housing 12 and a valve motor 14 which in turn through a suitable shaft 15 rotates a valve disk 16. The valve motor 14 is in fluid tight engagement with the upper housing 18 of the refrigerator 10, the upper housing 18 including means to support the valve stem 20 which includes a capillary 24 and a surge orifice 26 both of which communicate with a surge volume chamber 22. Communicating through valve stem 20 to valve disk 16 is an exhaust port 28 which in turn permits exhausting of low pressured expanded fluid from refrigerator 10 via suitable outlet fitting 29. High pressure inlet 30 includes means for admitting high pressure gas to the interior of the valve motor and pass the valve disk at the proper sequence through a passage 32 in valve stem 20 to the interior of slack piston 34 which in turn is in communication with a first stage displacer 36 having therein passage means to admit fluid to an interior passage 38 containing a regenerator 40. Fluid passing through first stage displacer 36 exits via passage 42 into a variable volume chamber 44 at the bottom of the first stage to produce refrigeration at a heat station 46. Fluid is passed from variable volume 44 through a conduit 48 through a bore 50 in second stage displacer 52 through a regenerator 54 to a second variable volume 56 which in turn can produce refrigeration at a second stage heat station 58.

Figure 2:
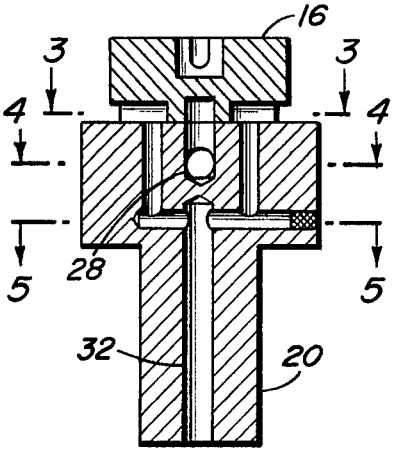
FIG. 2 is a schematic representation of the valve employed with prior art devices such as shown in FIG. 1.
Figure 6:
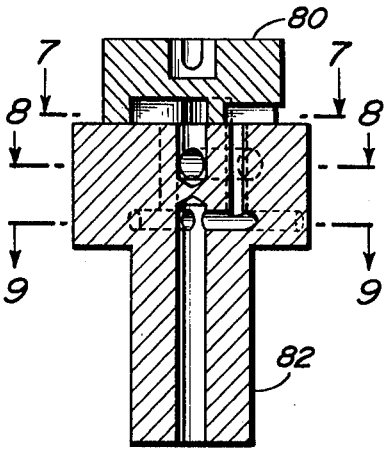
FIG. 6 is a cross-sectional representation of a valve according to the present invention.

In operation a device according to FIGS. 1 and 2 provides refrigeration by expansion of a working fluid such as helium. A source of helium is connected to high pressure inlet 30 and a suitable exhaust line is connected to exhaust or outlet fitting 29 to recover the helium for recycle. Refrigerator 10 operates by having the valve disk rotate to admit high pressure gas through the stem to the regenerator volumes 40, 54 of the first and second stage expanders. Slack piston 34 moves up quickly engaging the first stage displacer 36 thus compressing the small amount of gas trapped above it. Gas trapped above the slack piston 34 bleeds through the surge orifice 26 into the surge volume 22 at an intermediate pressure. High pressure gas continues to be fed through the regenerator to the cold end 46 of the first stage displacer 36 while it moves upwardly. The valve disk 16 closes the inlet to passage 32 before the displacer 36 reaches the top to partially expand the gas and slow down movement of the displacer 36. As the valve disk 16 rotates 90° from the position shown in FIG. 2 and connects the regenerators to the low pressure exit port 28 the slack cap moves down quickly until the gas above it is at a low pressure and it engages the first stage displacer 36. Gas bleeds from the surge volume 22 back through the surge orifice 26 as the displacer moves down and gas flows out through the regenerators. The exhaust port 28 closes before the displacer hits bottom slowing down the displacer to minimize the impact.

A device according to the invention is offered for sale by Air Products and Chemicals, Inc. as a Model CS202 refrigerator. The Model CS202 operates at 315/115 psig (2.17/0.79 MPa) with an intermediate pressure in the surge volume. Valve timing is such that the displacer is decelerated at each end of the stroke so that there is no audible tapping. Inertia forces are still present at the operating speed of 144 rpm (60 cycle power) and have to be considered in some applications. The pneumatic actuating forces are much greater than seal friction forces or other variable forces thus it has been found that operation is uniform for the life of the unit. Maintenance is facilitated because the pneumatic control and fixed ported disk require no adjustments. Wear rates on the seals and valve disk are low enough that long life has been designed into the parts.

Figure 3:
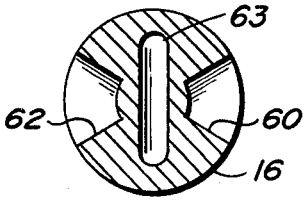
FIG. 3 is a view taken along line 3—3 of FIG. 2.
Figure 7:
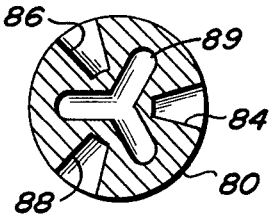
FIG. 7 is a section taken along the line 7—7 of FIG. 6.
Figure 4:
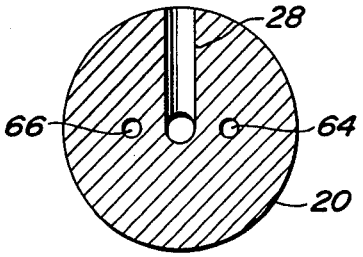
FIG. 4 is a view taken along the line 4—4 of FIG. 2.
Figure 8:
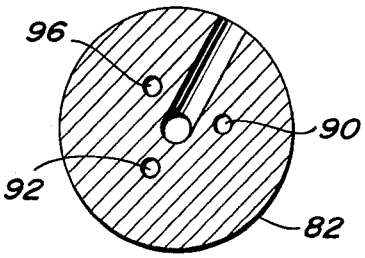
FIG. 8 is a view taken along the line 8—8 of FIG. 6.
Figure 5:
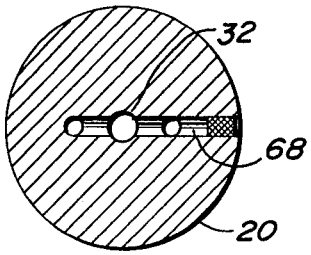
FIG. 5 is a view taken along the line 5—5 of FIG. 2.
Figure 9:
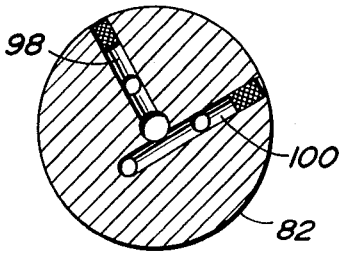
FIG. 9 is a view taken along the line 9—9 of FIG. 6.

Referring to FIGS. 2, 3, 4 and 5, the conventional valve disk 16 and valve stem 20 of FIG. 1 are shown. The valve disk as shown in FIG. 3 contains inlet apertures or slots 60, 62 spaced 180° apart which admit high pressure gas to ports 64 and 66, shown in FIG. 4. Slot 63 which is oriented approximately 90° from slots 60 and 62 connects ports 64 and 66 to low pressure port 28 to exhaust gas from the expansion spaces and regenerators. The two ports 64, 66 contained in the valve stem are extensions of passage 32 which serve to admit and remove working fluid from the displacer-expander type refrigerator. Valve disk 16 has enough space between slot 63 and slots 60 and 62 such that gas does not by-pass direct from high pressure to low pressure as it passes over ports 60 and 62. Valve stem 20 includes the capillary port 68 as shown in FIG. 1.

Referring to FIGS. 6 through 9 there is shown a valve disk 80 and valve stem 82 which contain respectively, three high pressure inlet apertures 84, 86, 88 and a low pressure slot 89 on the valve disk 80 and three ports 90, 92, 96 on the valve stem 82 for admitting and removing fluid from the regenerator volumes of the piston. The capillary port is included in valve stem 82 and is shown as 98. Also shown is a plug, 100. It is apparent that for every rotation of the valve disk the expander piston will reciprocate three times per revolution of the valve motor instead of two times with the valve shown in FIGS. 2 through 5.

The valve mechanism of the device of FIGS. 1 through 5 includes a stepping motor that rotates at 72 rpm on 60 cycle power which turns the valve disk over a valve stem with two ports that admits and vents gas every 180° of rotation of the valve disk thus causing the displacer to reciprocate at 144 rpm. Refrigeration that is produced is proportional to speed with other things being equal so that there is reduction in refrigeration of about 20% when a unit is operating on 50 cycle power. Attempts have been made to overcome this reduction by using a solid state frequency converter to drive the expander at 60 cycles.

Utilizing a valve according to FIGS. 6 through 9 when tested with the standard Model CS202 refrigerator the following results as set out in Table 1 were observed.

Table 1

| MOTOR FREQUENCY | VALVE TYPE | REFRIGERATION-WATTS FIRST STAGE | REFRIGERATION-WATTS SECOND STAGE |
|---|---|---|---|
| 60Hz | 2 port | 10.0 | 2.3 |
| 60Hz | 3 port | 14.0 | 2.8 |
| 50Hz | 2 port | 8.0 | 1.8 |

Table 1-continued

| MOTOR FREQUENCY | VALVE TYPE | REFRIGERATION-WATTS FIRST STAGE | REFRIGERATION-WATTS SECOND STAGE |
|---|---|---|---|
| 50Hz | 3 port | 11.0 | 2.2 |

From the examination of the data of Table 1 it is apparent that there was a significant increase in refrigeration when operating the conventional refrigerator at 50 or 60 cycle power.

It is within the scope of the present invention to operate the refrigerator with an increased number of ports to thus increase the speed of reciprocation and further increase refrigeration capacity.

It has also been observed that the increase in refrigeration capacity is due in part to the fact that the compressor (not shown) by-passes some flow at the normal rating conditions of 77° Kelvin at the first stage and 20° Kelvin at the second stage of the refrigerator with the 2 port valve while the flow is fully utilized with a 3 port valve. Thus, the 3 port valve enables more refrigeration to be produced in a given size expander but the higher piston speed somewhat reduces the life of the piston ring. However, such a refrigerator is viable from a commercial standpoint because it enables a higher capacity refrigerator to be produced with a small cost difference.

Having thus described my invention, what is desired to be secured by Letters Patent of the United States is set forth in the following claims:

1. In a cryogenic refrigerator of the type comprising a housing containing a piston, said piston and said housing defining a variable volume chamber, means to cause reciprocation of said piston by admission of a high pressure fluid to said variable volume chamber, said high pressure fluid causing movement of said piston to produce refrigeration by expansion of said fluid and electrically driven rotary valve means including a valve disk to admit and exhaust fluid from said variable volume chamber that improvement comprising:

increasing the number of ports of said rotary valve beyond two to at least three ports spaced 120° apart, whereby fluid is admitted to and exhausted from said variable volume chamber with more frequency than every 180° of rotation of said rotary valve thus increasing the speed of reciprocation of said piston and the refrigeration capacity of said refrigerator regardless of whether the motor used to rotate said valve is operated on 50 or 60 cycle power.

2. In a displacer-expander type cryogenic refrigerator of the type wherein said displacer is pneumatically actuated by an electrically driven rotary valve including a valve disk operating at fixed speed the improvement comprising:

increasing the number of ports of said rotary valve beyond two to at least three ports spaced 120° apart whereby fluid is admitted to and exhausted from said variable volume chamber with more frequency than every 180° of rotation of said valve thus increasing the speed of reciprocation of said piston and the refrigeration capacity of said refrigerator regardless of whether said valve is driven by a motor operating on 50 or 60 cycle power.

3. A method for increasing the refrigeration capacity of a cryogenic expander actuated pneumatically by an electrically driven rotary valve comprising the step of:

increasing the number of ports in said valve to admit and exhaust high pressure fluid from said expander at least three times per rotation of said valve whereby the refrigeration capacity of said refrigerator is increased regardless of whether said valve is driven by a motor operating on 50 or 60 cycle power.

* * * * *